US009377274B2

(12) United States Patent
Kincel

(10) Patent No.: US 9,377,274 B2
(45) Date of Patent: Jun. 28, 2016

(54) COUPLING FIREARM ACCESSORIES TO A FIREARM

(71) Applicant: Bravo Company USA, Inc., Hartland, WI (US)

(72) Inventor: Eric Stephen Kincel, Las Vegas, NV (US)

(73) Assignee: Bravo Company USA, Inc., Hartland, WI (US)

( * ) Notice: Subject to any disclaimer, the term of this patent is extended or adjusted under 35 U.S.C. 154(b) by 178 days.

(21) Appl. No.: 14/173,770

(22) Filed: Feb. 5, 2014

(65) Prior Publication Data

US 2015/0219422 A1 Aug. 6, 2015

(51) Int. Cl.

| | |
|---|---|
| ***F41C 23/16*** | (2006.01) |
| ***F41G 11/00*** | (2006.01) |
| ***B23P 11/00*** | (2006.01) |

(52) U.S. Cl.

CPC ..... *F41G 11/003* (2013.01); *F41C 23/16* (2013.01); *Y10T 29/49947* (2015.01); *Y10T 29/49963* (2015.01)

(58) Field of Classification Search

CPC ..... F41C 23/16; F41C 27/00; F41G 11/00; F41G 11/001; F41G 11/003; F41G 11/004; Y10T 29/49963; Y10T 29/49947

See application file for complete search history.

(56) References Cited

U.S. PATENT DOCUMENTS

| | | | | |
|---|---|---|---|---|
| 2,102,964 | A * | 12/1937 | Mossberg | F41C 23/02 224/150 |
| 3,066,375 | A | 12/1962 | Knowles et al. | |
| 3,559,940 | A * | 2/1971 | Kruzell | F41G 11/003 248/222.41 |
| 3,798,818 | A * | 3/1974 | Casull | F41C 23/12 42/72 |
| 7,770,317 | B1 | 8/2010 | Tankersley | |
| 8,245,428 | B2 | 8/2012 | Griffin | |
| 8,438,770 | B2 | 5/2013 | Troy | |
| 8,607,490 | B1 | 12/2013 | Zinsner | |
| 8,739,448 | B2 | 6/2014 | Kimmel et al. | |
| 8,752,320 | B2 * | 6/2014 | Masters | F41C 23/16 42/71.01 |
| D720,421 | S * | 12/2014 | Chen | D22/108 |
| 8,904,691 | B1 | 12/2014 | Kincel | |
| D722,356 | S * | 2/2015 | Keller | D22/108 |

(Continued)

FOREIGN PATENT DOCUMENTS

WO WO 2013/010515 1/2013

OTHER PUBLICATIONS

U.S. Appl. No. 14/152,889, Eric S. Kincel, Firearm Accessory Keyhold Locking Interface, filed Jan. 10, 2014.

(Continued)

*Primary Examiner* — Essama Omgba

(74) *Attorney, Agent, or Firm* — Lewis Roca Rothgerber Christie LLP

(57) ABSTRACT

A system for coupling various types of firearm accessories to a firearm having an accessory rail may include a coupling member. The coupling member may include a head and a threaded body. The head may have a diameter that fits through a first region of an accessory rail of a firearm but not through a second region. A method of coupling a firearm accessory to a firearm may include inserting the head of the coupling member through the first region of the accessory rail and moving the threaded body into the second region of the accessory rail. The method may further include driving the threaded body into the threaded hole such that the coupling member and firearm accessory are compressed against the accessory rail.

28 Claims, 4 Drawing Sheets

(56) References Cited

U.S. PATENT DOCUMENTS

| | | | | |
|---|---|---|---|---|
| 9,103,625 | B2 * | 8/2015 | Masters | F41C 23/16 |
| 9,239,209 | B2 * | 1/2016 | Mayberry | F41G 11/005 |
| 9,239,210 | B2 * | 1/2016 | Mayberry | F41C 23/16 |
| 2009/0100734 | A1 * | 4/2009 | Swan | F41G 11/003 42/71.01 |
| 2011/0126443 | A1 | 6/2011 | Sirois | |
| 2012/0124880 | A1 | 5/2012 | Leclair | |
| 2012/0167434 | A1 * | 7/2012 | Masters | F41C 23/16 42/90 |
| 2012/0186123 | A1 | 7/2012 | Troy et al. | |
| 2014/0026459 | A1 | 1/2014 | Yan et al. | |
| 2014/0041273 | A1 * | 2/2014 | Masters | F41C 23/16 42/71.01 |
| 2014/0115939 | A1 | 5/2014 | Troy et al. | |
| 2014/0130390 | A1 | 5/2014 | Geissele | |
| 2015/0198408 | A1 | 7/2015 | Kincel | |
| 2015/0219422 | A1 * | 8/2015 | Kincel | F41C 27/00 29/525.11 |
| 2015/0267993 | A1 * | 9/2015 | Cheng | F41C 27/00 42/90 |
| 2015/0316354 | A1 * | 11/2015 | Cheng | F41G 11/001 42/90 |

OTHER PUBLICATIONS

U.S. Appl. No. 14/152,889 Office Action mailed Jun. 5, 2015.

* cited by examiner

COUPLING FIREARM ACCESSORIES TO A FIREARM

BACKGROUND

1. Field of the Invention

The present disclosure concerns firearms. More particularly, the present disclosure concerns methods and systems for coupling various types of firearm accessories to a firearm.

2. Description of the Related Art

Firearm users have long desired ways to flexibly enhance the functionality of stock firearms. As a result, modern day firearms like the AR-15 and M-16 often feature an accessory rail capable of receiving one or more accessories such as a flashlight or sling mount. In most firearm designs, the accessory rail is either coupled to or permanently integrated with the barrel, upper receiver, handguard, or forestock of the firearm. The most well-known accessory rail is the Military Standard 1913 Picatinny Arsenal rail, commonly referred to simply as a "Picatinny rail." Although the Picatinny rail is still commonly used today, firearm designers have also begun producing other types of rails, including modular external accessory rails. One such modular external accessory rail is the KeyMod™ rail designed by Eric Kincel and VLTOR Weapon Systems of Tucson, Ariz.

To date, firearm users have typically coupled firearm accessories to accessory rails by using a traditional "screw and nut" method. When using the traditional screw and nut method, a user must align threaded holes in the accessory with a corresponding hole, groove, slot, or other opening in the accessory rail. There are several ways in which the accessory may be installed before it is secured in place by the screw and nut. After having aligned the accessory with the rail, the user must place a screw in each threaded hole and tighten the screw until it compresses the accessory against the rail. The tension applied by the compressed screw and nut holds the accessory in place against the accessory rail. One example of a firearm accessory that requires use of the screw and nut method is the QD Direct Attach Swivel Mount sold by Noveske Rifleworks LLC of Grants Pass, Oreg. Another example is the KeyMod QD RL Sling Mount sold by Impact Weapons Components, LLC of Timnath, Colo.

Other methods of coupling firearm accessories to accessory rails utilize slide-on mechanisms. In many cases, the top of the accessory contains a groove into which the bottom edge of a correspondingly shaped accessory rail slides. When using the slide-on method, a user must slide the accessory onto the rail. After doing so, the user must effectively "lock" the accessory in place to prevent further sliding along the rail. In many cases, the user must do so by tightening a "screw-core" locking mechanism that runs through the accessory. When tightened sufficiently, the screw-core protrudes from the accessory into a corresponding hole in the accessory rail. Having been fitted within the hole in the accessory rail, the protruding portion of the screw-core then impedes any further movement of the accessory along the rail.

A similar method relies on a rotatable accessory body. When using the rotatable body method, rather than having to slide the accessory into a groove in the accessory rail, the user must rotate the body of the accessory onto the edge of the rail before locking it into place using a screw-core mechanism. Another method features a thumb knob in place of the screw discussed above, while yet another requires the use of moveable clamps or throw-level tensioning devices to hold the accessory in place against the accessory rail.

Although adequate in some scenarios, each of the above methods suffers from one or more limitations. Some are less than optimal because they require the use of coupling mechanisms that feature numerous moving parts. When coupling mechanisms feature numerous moving parts, they are more expensive to manufacture and ultimately to purchase as a consumer. The use of many moving parts also increases the likelihood of mechanical failure. Other methods are suboptimal because they rely on coupling devices that, after having been installed, protrude from the firearm and risk getting snagged on clothing, equipment, or other nearby objects. Other methods are limited in their usefulness simply because they are inconvenient and/or difficult for users to perform. Given such limitations, there is a need in the firearm community for improved methods and systems of coupling various types of firearm accessories to a firearm.

SUMMARY OF THE CLAIMED INVENTION

Methods and systems for coupling various types of firearm accessories to a firearm are disclosed. Such firearm accessories may include flashlights, scopes, grips, supplemental rail panels, optical aiming devices (e.g., an infrared/laser sight), bipods, or any other desired accessories. In one exemplary embodiment, a method of coupling firearm accessories to a firearm may include inserting a head of a coupling member through a first region of a void in an accessory rail of the firearm. The void may have a second region with an area less than the area of the first region. The head may have a diameter that fits through the first region of the void but not through the second region of the void. The method may further include moving a threaded body of the coupling member into the second region of the void. The threaded body may have a drive region disposed at an end opposite the head. The method may include positioning a firearm accessory such that the threaded body of the coupling member protrudes into a threaded hole of the firearm accessory. The threaded hole may have a diameter and thread complementary to the diameter and thread of the threaded body of the coupling member. The method may also include driving the threaded body of the coupling member into the threaded hole of the firearm accessory such that the coupling member and firearm accessory are compressed against the accessory rail. Doing so may not require the use of a nut complementary to the coupling member, thereby reducing the overall number of components that must be manufactured, operated, and maintained.

In one exemplary embodiment, a system for coupling various types of firearm accessories to a firearm having an accessory rail may include a coupling member. The coupling member may include a head and a threaded body. The threaded body may have a drive region disposed at an end opposite the head. The head may have a diameter that fits through a first region of the accessory rail but not through a second region of the accessory rail. The area of the second region may be less than the area of the first region. The first and second regions of the accessory rail may be part of a common void. One exemplary accessory rail is the KeyMod™ rail, which is one example of a rail with a keyhole configuration. In operation, a user may use the system to couple a firearm accessory to the firearm. The firearm accessory may include a threaded hole that has a diameter and thread complementary to the diameter and thread of the threaded body of the coupling member.

DETAILED DESCRIPTION

Methods and systems for coupling various types of firearm accessories to a firearm are provided. Firearm accessories coupled to firearms using the methods and systems disclosed herein may enjoy substantially lower profiles than many accessories currently on the market. In various embodiments, because the head of the coupling member is disposed inside rather than outside the accessory rail, less material is exposed and positioned to cut the user or become snagged on equipment or environmental objects. These types of "high-speed low-drag" features are particularly sought after for military and law enforcement applications. The lower profile may also result in a substantially smoother and more appealing aesthetic finish.

Although certain embodiments of those methods and systems are discussed herein, it should be understood that they are exemplary only and in no way limit the scope of the present disclosure. Persons of ordinary skill in the art will readily recognize that the present disclosure suggests many other possible embodiments in addition to those expressly described herein. For instance, although embodiments are described in the context of coupling a sling mount accessory to a rail with a keyhole configuration (e.g., a KeyMod™ accessory rail), it should be readily apparent to persons of ordinary skill in the art that the methods and systems described herein are equally suitable for coupling other accessories, such as flashlights, vertical grips, supplemental rail panels, or any number of other firearm accessories. It should also be readily apparent to persons of ordinary skill in the art that the methods and system described herein are equally applicable to other types of accessory rails, such as the standard Picatinny rail. In other words, it is contemplated that the system and methods disclosed herein may be used to attach any firearm accessory to any type of accessory rail.

Figure 1:
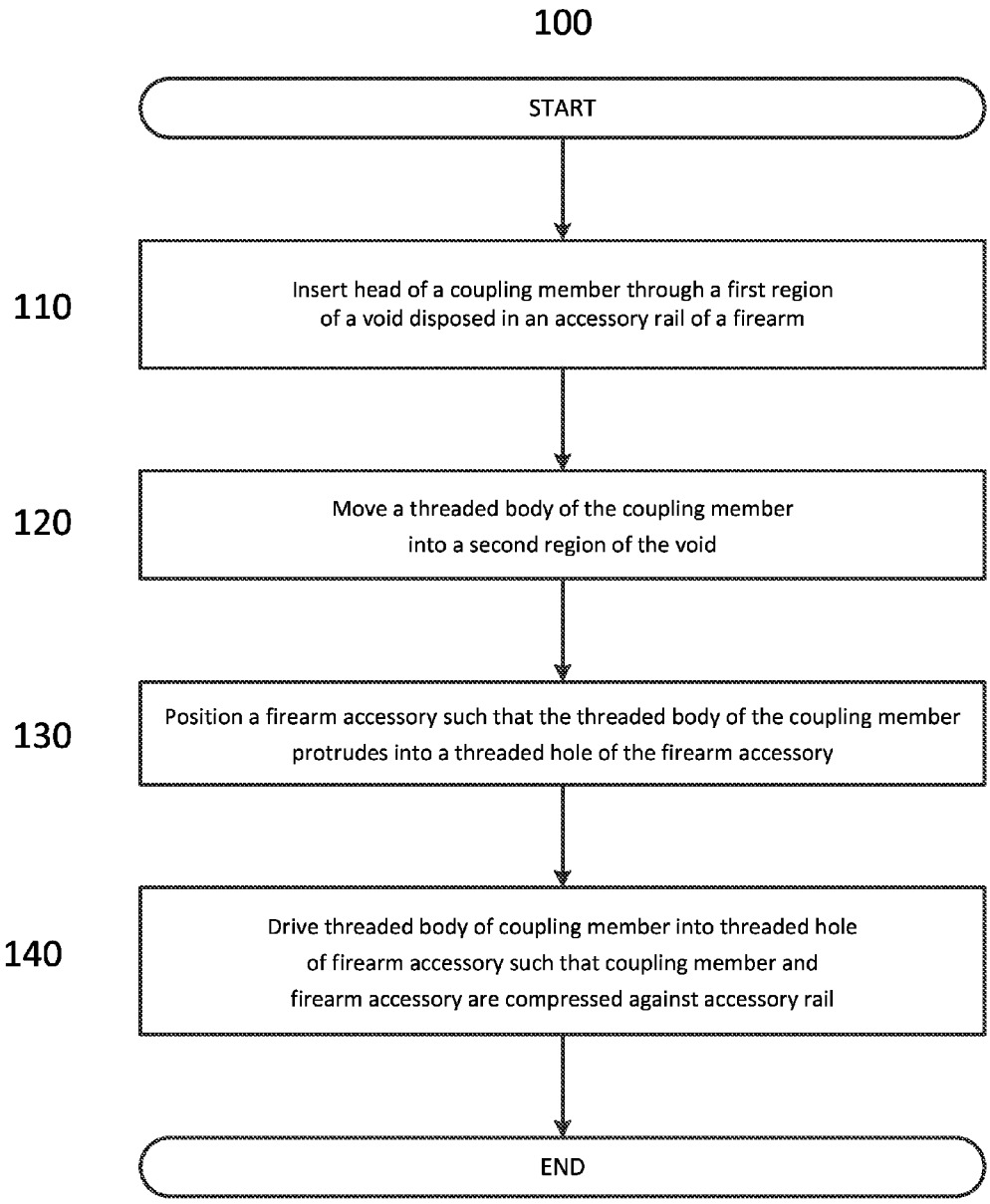
FIG. 1 is a flow diagram illustrating an exemplary method for coupling various types of firearm accessories to a firearm.

FIG. 1 is a flow diagram illustrating an exemplary method for coupling various types of firearm accessories to a firearm. In an embodiment, a method 100 of coupling a firearm accessory to a firearm may inserting a head of a coupling member through a first region of a void disposed in an accessory rail of the firearm at step 110. The void may have a second region with an area less than the area of the first region. The head may have a diameter that fits through the first region of the void but not through the second region of the void. The first region and the second region may each of which may be defined by a distinctly sized hollow area. In some embodiments, the first and second regions of the accessory rail may be part of a common void. In embodiments wherein the area of the second region is less than the area of the first region, objects of a certain diameter may pass through the first region without being able to pass through the second region.

Method 100 may further include moving a threaded body of the coupling member into the second region of the void at step 120. The threaded body may have a drive region disposed at an end opposite the head. The head may not include a drive region or any interface for a screwdriver or other tool. In some embodiments, the coupling member may be an inverted screw. Method 100 may also include positioning a firearm accessory such that the threaded body of the coupling member protrudes into a threaded hole of the firearm accessory at step 130. The threaded hole may have a diameter and thread complementary to the diameter and thread of the threaded body of the coupling member.

At step 140, method 100 may further include driving the threaded body of the coupling member into the threaded hole of the firearm accessory such that the coupling member and firearm accessory are compressed against the accessory rail.

The accessory rail may be a standard or modified Picatinny rail, a modular external accessory rail that mates with firearm accessories and may have a keyhole configuration (e.g., a KeyMod™ rail), or any other suitable type of accessory rail. For illustrative purposes, the figures disclosed herein depict embodiments in a context wherein the firearm accessory is a sling mount. It should be clearly understood, however, that the methods and systems may also be used with any other suitable firearm accessory, such as a flashlight, a scope, a laser sight, a grip, a supplemental Picatinny rail panel, or a supplemental modular external accessory rail panel that mates with firearm accessories (e.g., a supplemental KeyMod™ rail panel).

In some embodiments, driving the coupling member into the firearm accessory such that the coupling member and firearm accessory are compressed against the accessory rail may not require using a nut complementary to the coupling member. For instance, in one embodiment, the coupling member may be an inverted screw or similar fastening device. The inverted screw may include a head and a threaded body. Unlike a conventional screw, which features a drive region at the head of the screw, the inverted screw may feature a drive region disposed in the threaded body at the end opposite the head. The drive region may be a female depression or hole that mates with a correspondingly shaped male member, such as the head of a hex or "Allen" wrench, a six lobe drive, a screwdriver, or other suitable driving tool.

In some embodiments, the complementary threads of the threaded body and threaded hole may be reverse threads. The threads of conventional screws are designed such that the application of a rotational force to the drive region upon the head of the screw in a clock-wise direction drives the screw away from the drive region. The same force applied to the drive region of an inverted screw featuring left-handed threads and a drive region disposed at the end of the threaded body opposite the head, however, drives the screw towards the drive region. As a result, any object (e.g., the surface of an accessory rail) positioned between the head of the screw and the drive region is forced towards the drive region. Alternatively, the threads may be right-handed.

When an accessory featuring complementary threaded holes is coupled to the threaded body of the inverted screw, the screw is driven towards the coupled accessory until the head of the screw and the accessory meet at the intervening object. Absent any further space for the head of the screw and/or accessory to travel along the length of the threaded body of the screw, driving the screw further applies an opposing force to each side of the intervening object. As a result, the accessory is effectively compressed securely against the intervening object by the inverted screw.

In some embodiments, method 100 may include the use of a firearm accessory that itself couples with a further component. For instance, the firearm accessory may include a first coupling region that mates with a second coupling region of an additional accessory component. The first coupling region may be a female depression or hole. The female depression or hole may mate with a male member of an additional accessory component, such as a sling swivel. One exemplary swing swivel is the Uncle Mike's style QDS Quick Detachable Sling Swivel by VLTOR Weapon Systems of Tucson, Ariz. The firearm accessory may also include a recoil lug.

Figure 2A:
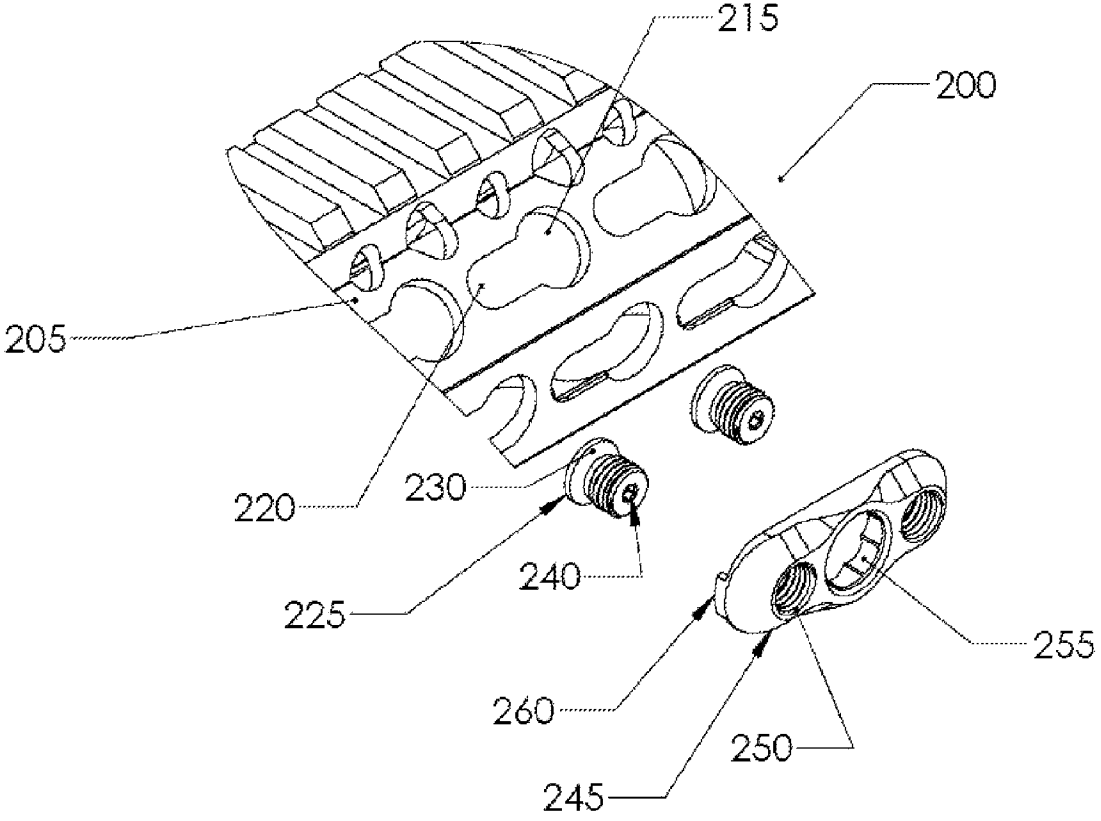
FIG. 2A is an exploded perspective view of an exemplary system for coupling various types of firearm accessories to a firearm.

FIG. 2A is an exploded perspective view of an exemplary system for coupling a firearm accessory to a firearm. In an embodiment, system 200 may include a firearm having an accessory rail 205. Accessory rail 205 may include a first region 215 and a second region 220, each of which may be defined by a distinctly sized hollow area. In some embodiments, first region 215 and second region 220 may be part of a common void 210. The area of second region 220 may be less than the area of first region 215. As a result, objects of a certain diameter may pass through first region 215 without being able to pass through second region 220. In some embodiments, accessory rail 205 may include a plurality of voids 210. Using a firearm with an accessory rail 205 that has a plurality of voids 210 may be particularly useful when the user desires to couple the firearm with certain firearm accessories that feature multiple threaded holes (discussed further below). For illustrative purposes, the figures disclosed herein depict embodiments wherein the accessory rail is a KeyMod™ rail. Persons of ordinary skill in the art will readily recognize, however, that the methods and systems disclosed herein may apply to many other types of accessory rails, such as standard Picatinny rails, modified Picatinny rails, or other modular external accessory rails or rails with keyhole configurations apart from the KeyMod™ rail that receive firearm accessories.

System 200 may further include a coupling member 225. Coupling member 225 may include a head 230 attached to a threaded body 235. Head 230 may not include a drive region or any interface for a screwdriver or other tool. Head 230 may have a diameter that fits through first region 215 of accessory rail 205 but not through second region 220 of accessory rail 205. As shown in the embodiment illustrated in FIG. 2A, head 230 may have a diameter that fits through first region 215 of void 210 disposed in accessory rail 205 but not through second region 220 of void 210. Head 235 may be a flat disc or sheet, a tapered region, or any other suitable geometric structure. Threaded body 235 may include a drive region 240 disposed at an end opposite the head. For instance, in one embodiment, coupling member 225 may be an inverted screw or similar fastening device. Unlike a conventional screw, which features a drive region at the head of the screw, inverted screw 225 may feature drive region 240 disposed in threaded body 235 at the end opposite head 230. Drive region 240 may be a female depression or hole that mates with a correspondingly shaped male member, such as the head of a hex or Allen wrench, six lobe drive, screwdriver, or other suitable driving tool (not shown). System 200 may further include a firearm accessory 245. Firearm accessory 245 may include a threaded hole 250. Threaded hole 250 may have a diameter and thread complementary to the diameter and thread of threaded body 235 of coupling member 225. In some embodiments, firearm accessory 245 may include a plurality of threaded holes 250. As noted above, providing a firearm with an accessory rail 205 that has multiple voids 210 may be particularly useful when firearm accessory 245 features multiple threaded holes. For illustrative purposes, the figures disclosed herein depict embodiments wherein the firearm accessory is a sling mount. It should be clearly understood, however, that the methods and systems may also be used with any other suitable firearm accessory, such as a flashlight, a scope, an optical aiming device (e.g., an infrared/laser sight), a bipod, a grip, a supplemental Picatinny rail panel, or a supplemental modular external accessory rail panel that mates with firearm accessories (e.g., a supplemental KeyMod™ rail panel).

In operation, a user may use system 100 to couple firearm accessory 245 to accessory rail 205 of a firearm by first inserting the head of the coupling member 225 through the first region of the void 210. Next, the user may move the threaded body 235 of the coupling member 225 into the second region of the void 210 at step 140. With respect to the embodiment shown in FIG. 2, the user may simply slide the coupling member 225 over into the second region of the void 210. The user may then position the firearm accessory such that the threaded body 235 of the coupling member 225 protrudes into the threaded hole 250 of the firearm accessory. Once the firearm accessory and coupling member are aligned, the user may drive the threaded body 235 of the coupling member 225 into the threaded hole 250 of the firearm accessory such that the coupling member 225 and firearm accessory are compressed against the accessory rail.

In some embodiments, the complementary threads of threaded body 235 and threaded hole 250 may be left-handed threads. The threads of conventional screws are designed such that the application of a rotational force to the drive region upon the head of the screw in a clock-wise direction drives the screw away from the drive region. The same force applied to drive region 240 of inverted screw 225 featuring left-handed threads and drive region 240 disposed at the end of threaded body 235 opposite head 230, however, drives inverted screw 225 towards drive region 240. As a result, any object (e.g., a portion of accessory rail 205) positioned between head 230 of inverted screw 225 and drive region 240 is forced towards drive region 240. Alternatively, the threads may be right-handed.

In such embodiments, when accessory 245 featuring complementary threaded hole 245 is coupled to threaded body 235 of inverted screw 225, inverted screw 225 is driven towards the coupled accessory until head 230 and accessory 245 are each left without any further room to travel along the length of threaded body 235 of inverted screw 225. As a result, driving inverted screw 225 any further applies an opposing force to each side of the intervening portion of accessory rail 205 such that firearm accessory 245 is effectively compressed securely against accessory rail 205.

Figure 2B:
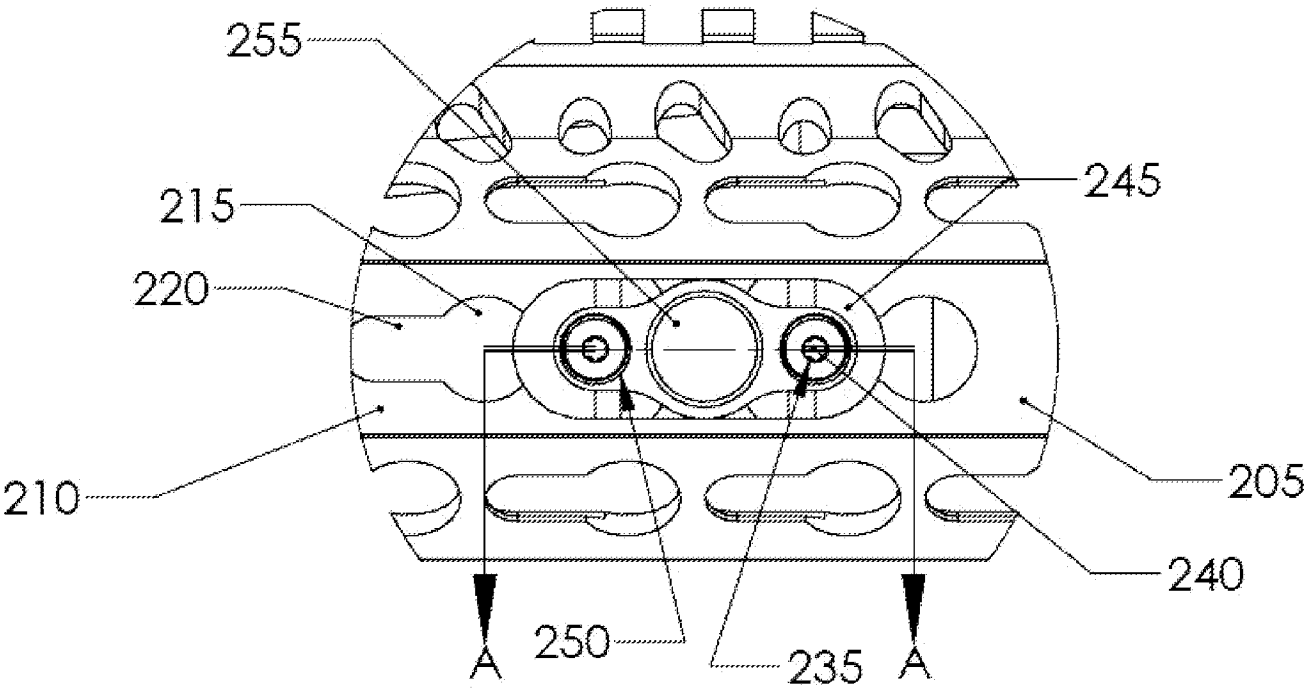
FIG. 2B is a side view of an exemplary system for coupling various types of firearm accessories to a firearm.

FIG. 2B is a side view of an exemplary system for coupling various types of firearm accessories to a firearm. In some embodiments, firearm accessory 245 may itself couple with an additional component. For instance, firearm accessory 245 may include a first coupling region 255 that mates with a second coupling region of an additional accessory component (not shown). As shown in FIG. 2B, first coupling region 255 may be a female depression or hole. The female depression or hole may mate with a male member of an additional accessory component, such as a sling swivel (not shown). In other embodiments, first coupling region 255 may be a male member and the additional component may include the complementary female depression or hole. Any number of other suitable coupling mechanisms may likewise be used to couple firearm accessory 245 to an additional component.

Where the user desires to couple to the firearm a firearm accessory 245 that itself couples to an additional component, it may be particularly beneficial for first coupling region 255 to align with a region of accessory rail 205 having sufficient space to receive the second coupling region of the additional component. For example, as illustrated in FIG. 2B, firearm accessory 245 is a sling mount. Accessory rail 205 is an exemplary form of an external modular rail system that has a keyhole configuration and is referred to above as a KeyMod™ rail. KeyMod™ rail 205 includes a plurality of spaced voids 210, each of which has a first region 215 and a second region 220 as discussed above. Voids 210 may be shaped like keyholes. Sling mount 245 includes two threaded holes 250, each of which has been coupled with a corresponding threaded body 235 of a coupling member 225. Drive region 240 is visible at the end of each threaded body 235. In this particular exemplary embodiment, drive region 240 is a depression having a geometry that receives a correspondingly shaped end of a hex or Allen wrench.

Threaded holes 250 of sling mount 245 are spaced such that when threaded holes 250 may each be aligned with second region 220 of a void 210. First coupling region 255 may be spaced between threaded holes 250 such that when each threaded hole 250 is aligned with a second region 220 of a void 210, first coupling region 255 is aligned with first region 215 of a void 210. For instance, as shown in FIG. 2B, when coupled to KeyMod™ rail 205, sling mount 245 spans three voids 210—a left void 210, a center void 210, and a right void 210. Left threaded hole 250 couples with left coupling member 225 through second region 220 of left void 210. Right threaded hole 250 couples with right coupling member 225 through second region 220 of right void 210. In this exemplary configuration, no coupling member 225 passes through center void 210. Rather, first coupling region 255 aligns with first region 215 of center void 210 to form a continuous collective void through which the second coupling region of the sling swivel may couple to sling mount 245. In other embodiments, such as the one illustrated in FIG. 2C, threaded holes 250 and first coupling region 255 may be spaced such that of firearm accessory 245 only spans two voids 210 when coupled to accessory rail 205.

Figure 2C:
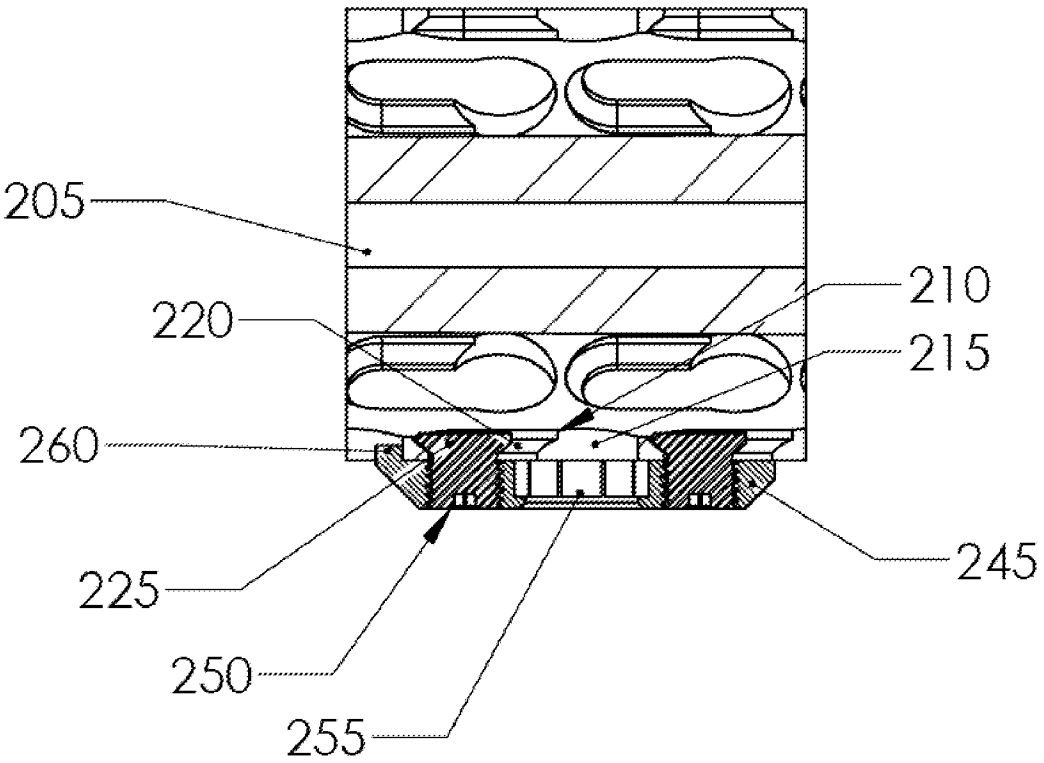
FIG. 2C is a top view of an exemplary system for coupling various types of firearm accessories to a firearm.

FIG. 2C is a top view of an exemplary system for coupling various types of firearm accessories to a firearm. FIG. 2C shows an additional exemplary embodiment wherein first coupling region 255 may be aligned and concentric with first region 215 of void 210 when coupling member 225 is coupled to threaded hole 250 of firearm accessory 245 through second region 220 of void 210 in accessory rail 205. As in the embodiment shown in FIG. 2B, the concentric alignment of first coupling region 255 with first region 215 of void 210 may result in a continuous collective void that provides appropriate clearance for a second coupling region of an additional accessory component. For instance, where the second coupling region of the additional accessory component is a male member, the concentric alignment may provide adequate clearance for the male member to extend inwardly into first coupling region 255 without being inhibited by the outer surface of accessory rail 205.

Firearm accessory 245 may further include a recoil lug 260. Recoil lug 260 may be spaced from threaded hole 250 such that, when firearm accessory 245 is properly coupled to accessory rail 205, recoil lug 260 rests snugly against the inner edge of a void 210 of accessory rail 205. In the illustrative embodiment shown in FIG. 2B, recoil lug 260 is hidden from view beneath the far left edge of sling mount 245 (against the inner edge of first region 215 of void 210). In some embodiments, recoil lug 260 may be slightly offset from the inner edge of void 210 such that a user must apply pressure to recoil lug 260 to make it "snap" into place against the inner edge. Recoil lug 260 may help to stabilize firearm accessory 245 against natural component stress caused by firearm recoil. More particularly, recoil lug 260 may help to transfer some of the stress forces caused by firearm recoil away from coupling member 225. In that way, recoil lug 260 may help to prolong the life of coupling member 225, which like all mechanical parts may be naturally inclined to weaken over time after heavy use.

The above description is illustrative and not restrictive. Many variations of the invention will become apparent to those of skill in the art upon review of this disclosure. While the present invention has been described in connection with a variety of embodiments, these descriptions are not intended to limit the scope of the invention to the particular forms set forth herein. To the contrary, the present descriptions are intended to cover alternatives, modifications, and equivalents as may be included within the spirit and scope of the invention as defined by the appended claim and otherwise appreciated by one of ordinary skill in the art.

What is claimed is:

1. A method of coupling firearm accessories to a firearm, the method comprising:

coupling an end of a body of a coupling member to a hole in a firearm accessory, the end disposed opposite a head of the body and including a drive region;

inserting the head of the coupling member through a first region of a first void disposed in an accessory rail of the firearm, the first void having a second region with an area less than an area of the first region, the head having a diameter that fits through the first region of the void but not through the second region of the void;

sliding the firearm accessory, wherein sliding the firearm accessory moves the body of the coupling member into the second region of the first void and moves a recoil lug of the firearm accessory into a first region of a second void disposed in the accessory rail, the second void having a second region with an area less than an area of the first region; and driving the body of the coupling member via the drive region into the hole of the firearm accessory, wherein driving the body brings the head of the coupling member into compression with a surface at least partially defining the first void of the accessory rail and brings the recoil lug of the firearm accessory into compression with a surface at least partially defining the second void of the accessory rail.

2. The method of claim 1, wherein the accessory rail is a Picatinny rail.

3. The method of claim 1, wherein the accessory rail is a modular external accessory rail that mates with firearm accessories.

4. The method of claim 1, wherein the accessory rail is a rail with a keyhole configuration.

5. The method of claim 1, wherein the body of the coupling member includes left-handed threads.

6. The method of claim 1, wherein the firearm accessory further includes a first coupling region that mates with a second coupling region of an additional firearm accessory component.

7. The method of claim 1, wherein the firearm accessory is a sling mount.

8. The method of claim 1, wherein the firearm accessory is a flashlight.

9. The method of claim 1, wherein the firearm accessory is a supplemental Picatinny rail panel.

10. The method of claim 1, wherein the firearm accessory is a supplemental modular external accessory rail panel that mates with firearm accessories.

11. The method of claim 1, wherein the firearm accessory is a rail panel with a keyhole configuration.

12. The method of claim 1, wherein the coupling member is an inverted screw.

13. The method of claim 1, wherein driving the coupling member into the hole of the firearm accessory does not require the use of a nut complementary to the coupling member.

14. A system for coupling a firearm accessory to a firearm having an accessory rail, the system comprising:

a firearm accessory, the firearm accessory including a hole and a recoil lug; and a coupling member that secures the firearm accessory to the accessory rail of the firearm, the coupling member including a head and a body, the head having a diameter that fits through a first region of a first void in the accessory rail but not through a second region of the first void, the body having a drive region disposed at an end opposite the head, and the accessory rail including a second void disposed adjacent to the first void, wherein the coupling member secures the firearm accessory to the accessory rail when the end of the coupling member is partially driven into the hole of the firearm accessory, the head of the coupling member is inserted into the first region of the first void in the accessory rail and slid into the second region, and the end of the coupling member is subsequently driven into the hole of the firearm accessory to bring the head of the coupling member into compression with a surface at least partially defining the first region of the first void in the accessory rail and to bring the recoil lug of the firearm accessory into compression with a surface at least partially defining the second void of the accessory rail.

15. The system of claim 14, wherein the hole of the firearm accessory is a threaded hole, the body is a threaded body, and the threaded hole includes a diameter and thread complementary to a diameter and thread of the threaded body of the coupling member.

16. The system of claim 15, wherein the threads of the threaded body and the threads of the threaded hole are left-handed threads.

17. The system of claim 15, wherein the threads of the threaded body and the threads of the threaded hole are right-handed threads.

18. The system of claim 14, wherein the area of the second region is less than the area of the first region.

19. The system of claim 14, wherein the accessory rail is a Picatinny rail.

20. The system of claim 14, wherein the accessory rail is a modular external accessory rail that mates with firearm accessories.

21. The system of claim 14, wherein the accessory rail is a rail with a keyhole configuration rail.

22. The system of claim 14, wherein the firearm accessory further includes a first coupling region that mates with a second coupling region of an additional firearm accessory component.

23. The system of claim 14, wherein the firearm accessory is a sling mount.

24. The system of claim 14, wherein the firearm accessory is a flashlight.

25. The system of claim 14, wherein the firearm accessory is a supplemental Picatinny rail panel.

26. The system of claim 14, wherein the firearm accessory is a supplemental modular external accessory rail panel that mates with firearm accessories.

27. The system of claim 14, wherein the firearm accessory is a supplemental panel of a rail with a keyhole configuration.

28. The system of claim 14, wherein the coupling member is an inverted screw.

* * * * *